US005118161A

United States Patent [19]

Slowe et al.

[11] Patent Number: 5,118,161

[45] Date of Patent: Jun. 2, 1992

[54] FRONT RELEASE MECHANISM FOR HIGH CHAIR TRAY

[75] Inventors: James Slowe; Stanley Kujawski, both of East Aurora, N.Y.

[73] Assignee: Kolcraft Enterprises Inc., Chicago, Ill.

[21] Appl. No.: 596,772

[22] Filed: Oct. 11, 1990

[51] Int. Cl.[5] ..... A47B 83/02

[52] U.S. Cl. ..... 297/153; 297/151

[58] Field of Search ..... 297/153, 151, 149, 148; 292/213, 218, 228, DIG. 46

[56] References Cited

U.S. PATENT DOCUMENTS

| | | | |
|---|---|---|---|
| 1,182,938 | 5/1916 | Snideman | 297/153 |
| 1,489,965 | 4/1924 | Prentice | 292/DIG. 46 X |
| 2,115,860 | 5/1938 | Kroll et al. | 297/151 |
| 2,118,509 | 5/1938 | Heinritz | 297/151 |
| 2,155,813 | 4/1939 | Veal | 297/151 |
| 2,505,490 | 4/1950 | Greenbaum . | |
| 2,937,694 | 5/1960 | Willson . | |
| 3,874,725 | 4/1975 | Perry . | |
| 4,165,123 | 8/1979 | Hutson . | |
| 4,373,756 | 2/1983 | Purdy . | |
| 4,582,359 | 4/1986 | Wise . | |
| 4,606,576 | 8/1986 | Jones . | |
| 4,723,813 | 2/1988 | Kassai . | |
| 4,807,928 | 2/1989 | Cone . | |
| 4,842,331 | 6/1989 | Waples . | |
| 4,968,092 | 11/1990 | Giambrone | 297/151 |

*Primary Examiner*—Kenneth J. Dorner
*Assistant Examiner*—J. Bonifanti
*Attorney, Agent, or Firm*—Rosenthal & Schanfield

[57] ABSTRACT

A device for releasably securing a tray to a chair having two extending arms with a plurality of consecutive recessed grooves on the underside of each arm which comprises a one-piece pivot bar; a pivot element for pivotably connecting the pivot bar to the bottom of the tray; the pivot bar comprising an operable front portion forward of the pivot element, a back portion rearward of the pivot element, and at least two pins extending from the back portion for engaging the grooves; attachment elements proximate the pivot element for rotatably securing the pivot bar to the bottom of the tray; and a biasing element associated with the pivot bar for urging the pins toward the bottom surface of the tray and into corresponding grooves when the tray is positioned on the arms of the chair to secure the tray to said arms, whereby operation of the pivot bar in opposition to the biasing means causes the pins to retreat from the grooves.

26 Claims, 4 Drawing Sheets

FRONT RELEASE MECHANISM FOR HIGH CHAIR TRAY

FIELD OF THE INVENTION

This invention relates to infant high chairs and mechanisms for releasably attaching trays thereto. More specifically, the invention relates to a front release mechanism integral with the high chair tray which is operable by one or both hands to permit the tray to be attached to the high chair, adjusted horizontally with respect to the high chair, and detached from the high chair.

BACKGROUND OF THE INVENTION

High chairs are used to seat infants who are too small to be seated in standard chairs. High chairs are typically provided with a tray spanning the arms of the chair in front of the infant. The tray serves to restrain the infant within the chair and provide a horizontal surface for holding food during feedings or toys or the like at other times.

High chair trays are typically provided with release mechanisms to allow the tray to be removed to facilitate placing the infant in the high chair and removing him or her therefrom. These mechanisms generally comprise two latches or detent means, one on each side of the bottom surface of the tray, which are spring biased into corresponding slots or recesses incorporated into the arms of the chair. A plurality of consecutive slots or recesses are usually provided to allow the tray to be adjustable horizontally with respect to the high chair so that the tray can be positioned accordingly with respect to the infant. The latches are generally capable of securing the tray to the chair so as to prevent tipping or movement in the vertical direction when the tray is attached to the chair. The tray release mechanism is hand operable by means of levers or the like connected to or formed as part of each latch or detent. Thus, both hands are generally required to attach the tray to the high chair or adjust the tray horizontally with respect to the high chair. These operations can be difficult considering that they must be performed while at the same time trying to restrain the infant within the high chair.

Thus, it has become desirable to provide high chair trays with release mechanisms comprising a single lever or the like which operates both latch means to enable the tray to be removed or adjusted with one hand, thus freeing up the other hand to deal with the child. Several such release mechanisms are known in the art. For example, U.S. Pat. No. 4,842,331 to Waples, issued Jun. 27, 1989, discloses a mechanism which is operated by a single plunger attached by way of several linkages to the latches connecting the tray to the arms of the high chair. While the plunger rotates the latches to a position wherein the tray is adjustable horizontally with respect to the high chair, both hands are required to disengage the latches from the arms so that the tray can be removed from the high chair. U.S. Pat. No, 4,807,928 to Cone, issued Feb. 28, 1989, discloses a single-hand operable mechanism which comprises a handle connected to two latch members by way of respective pivot plates. The handle is operable in one direction to disengage engagement arms on the ends of the latch members so that the tray can be removed from the high chair, and in the other direction to allow the tray to be adjusted horizontally with respect to the high chair while it is securely attached to the chair. U.S. Pat. No. 4,723,813 to Kassai, issued Feb. 9, 1988, also discloses a slide member operating means operable by one hand. This device comprises an operating button connected by several elements to a hook or operating lever which operates to disengage the operating lever from the high chair support frames, thus allowing the tray to be removed from the high chair. Another one-hand operable high chair tray release mechanism is shown in U.S. Pat. No. 4,582,359, to Wise, et al., issued Apr. 15, 1986, which discloses a handle located at the side of the tray that is operable to withdraw two pegs connected by a peg arm from corresponding holes in the high chair arms so that the tray can be removed.

While these devices offer the advantage of one-handed operation, the multi-element linkages required to connect the operating handles to the latch elements necessitate additional manufacturing and assembly operations and can add to the time and cost required to produce the high chair trays. In addition, since injury to the infant can result from exposed pinch points, linkages and sharp edges, it is often necessary to eliminate such dangers by covering the entire release mechanism or sandwiching it between a bottom cover and the bottom of the tray. This also adds to the cost of the materials used to produce the tray. Furthermore, it is desirable that the tray be securable to the high chair during horizontal adjustment thereof to prevent it from being tipped by the infant or by other causes.

Moreover, while some existing release mechanisms provide the convenience of one-hand operation, the handles or levers are located at a discrete location along the periphery of the tray, requiring grasping of the tray at only that location. Furthermore, existing handles or levers require movements of the hand and fingers which do not coincide with the gripping motion typically required to hold and transport the tray with one hand.

SUMMARY OF THE INVENTION

Therefore, it is an object of the present invention to provide a high chair tray having a single-hand operable release mechanism which is comprised of relatively few parts and is therefore simple to manufacture and assemble and cost effective to produce. It is another object of the present invention to provide a release mechanism having no linkages to complicate the manufacture of the tray or exposed pinch points or sharp edges which may injure the infant.

Another object of the invention is to provide a high chair tray which remains attached to the high chair while the tray is being adjusted horizontally with respect to the tray.

A further object of the invention is to provide a high chair tray with a front release mechanism having an operating handle or lever that can be actuated from several locations along the periphery of the tray and which is ergonomically designed and operable to comport to the natural manipulations of a hand holding the tray.

According to the present invention, these and other objects are achieved by providing a high chair tray with a release mechanism comprising a single arcuate lever or pivot bar extending from the front to the sides of the tray along the underside of the tray and having a pin extending inwardly from each end, a means for pivotably connecting the pivot bar to the underside of the tray, attachment means proximate the pivot means for securing the pivot bar to the underside of the tray, and means for biasing the pivot bar and the pins on the end of the bar into engagement with corresponding grooves or indents on the underside of each arm of the high chair to thereby secure the tray in one of a number of positions corresponding to the number of recesses in the high chair arms. Since the pivot bar extends along the front and side peripheries of the tray, the center portion of the underside of the tray is unobstructed by moving parts and linkages which could injure a child. The high chair tray is further provided with guide clips adjacent each end of the pivot bar to guide the tray onto the arms of the high chair and to resist vertical or lateral movement of the tray while it is being adjusted horizontally with respect to the high chair. A set of guide rails extending along the sides of each guide clip and the ends of the pivot bar aid in positioning the tray vertically with respect to the arms of the chair and thereby maintain the grooves on the undersides of the arms in contact with the pins on the pivot bar when the bar is in the relaxed, engaged position. The tray further comprises an arcuate guard wall attached to the underside of the tray along the side of the pivot bar extending beyond both guide rails to eliminate any exposed pinch points between the pivot bar and the underside of the tray which may injure the child.

The release mechanism is ergonomically designed so that the pivot bar can be operated using the same gripping motion a person would employ to lift and hold the tray with one hand. Furthermore, since the pivot bar extends along the entire front periphery of the tray, the release mechanism can be actuated by gripping the bar at one of several locations along the forward periphery of the tray. Moreover, the present invention does not employ any intermediary linkages between the pivot bar and the latch or pin. Therefore, the manufacture of the various parts and the assembly of the tray are simplified, thus reducing material and production costs. In operation, the pivot bar is simply gripped with the tray, either with one hand anywhere along the front of the tray or with two hands at the sides of the tray, and pressed to release the pins from the corresponding grooves on the undersides of the high chair arms. The tray can then either be adjusted horizontally with respect to the high chair by sliding the tray along the arms until the pins engage other grooves, or removed from the high chair altogether by sliding the tray forward until the guide clips are free of the arms. The tray can be replaced with one hand in the same manner by placing the tray on the arms of the high chair and sliding it backwards until the pins engage with the appropriate grooves.

These and other objects and advantages of the present invention will be made apparent from the following detailed description, with reference to the accompanying drawings.

DETAILED DESCRIPTION OF THE PREFERRED EMBODIMENT

Figure 1:
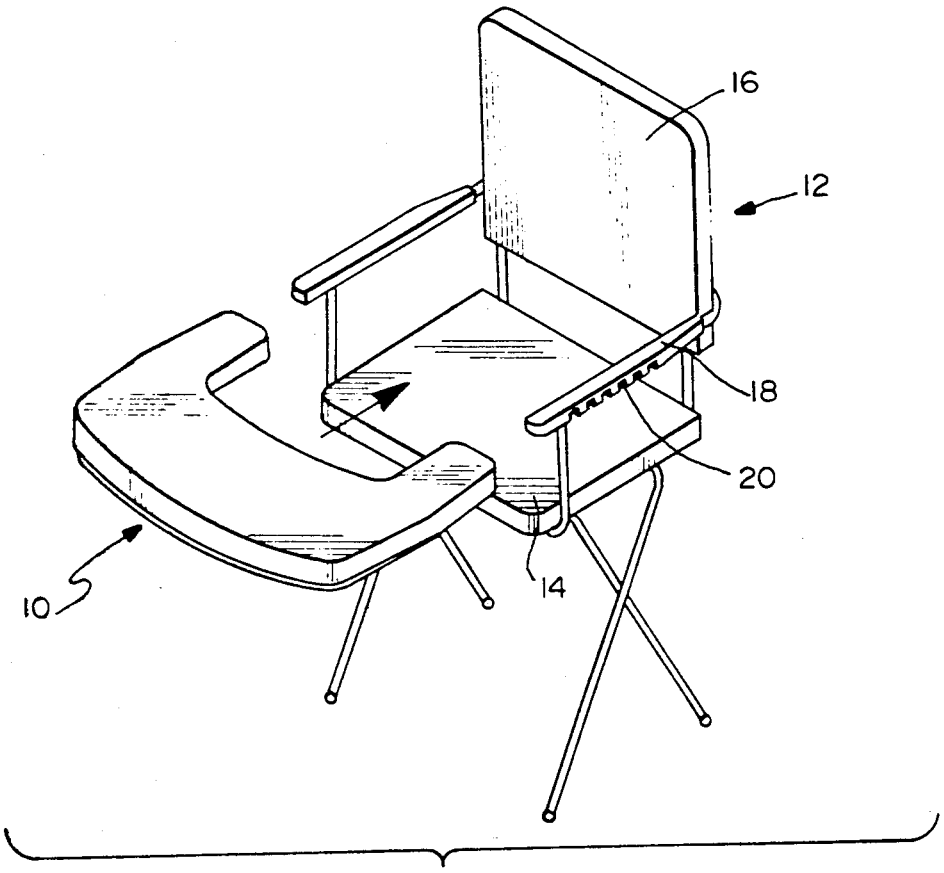
FIG. 1 is a perspective view showing a high chair with a tray incorporating the present invention removed from the chair.

In referring to the Drawings, it is to be noted that in FIGS. 2 through 5, the tray of the present invention and its elements are inverted to provide a better view of the invention. Therefore, unless otherwise obvious, all references to location and direction in descriptions concerning FIGS. 2 through 5 should be understood as being relative to this inverted condition. Referring to FIG. 1, a tray 10 incorporating the present invention is shown along with its high chair 12, which comprises a seat 14, a back 16 and two forward extending, generally rectangular arms 18. The undersides of arms 18 each contain a plurality of consecutive, recessed grooves or indents 20 extending through the outer side surfaces of arms 18. Tray 10 is supported on arms 18 and attached thereto in a manner to be described below.

Figure 2:
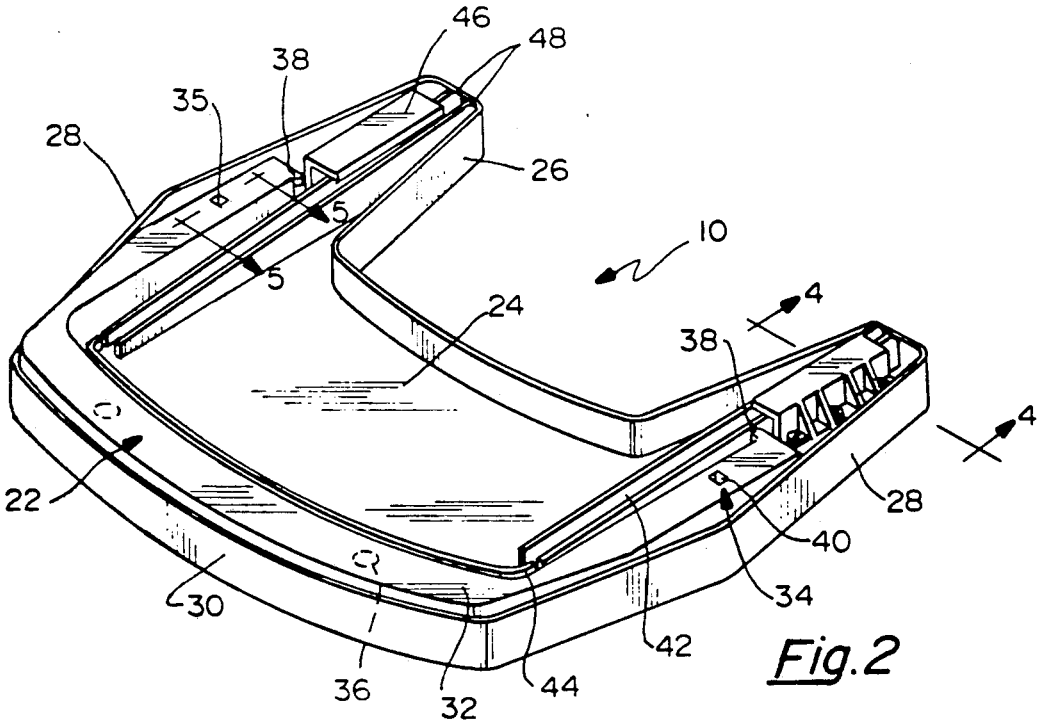
FIG. 2 is an orthogonal view of the underside of the tray.
Figure 3:
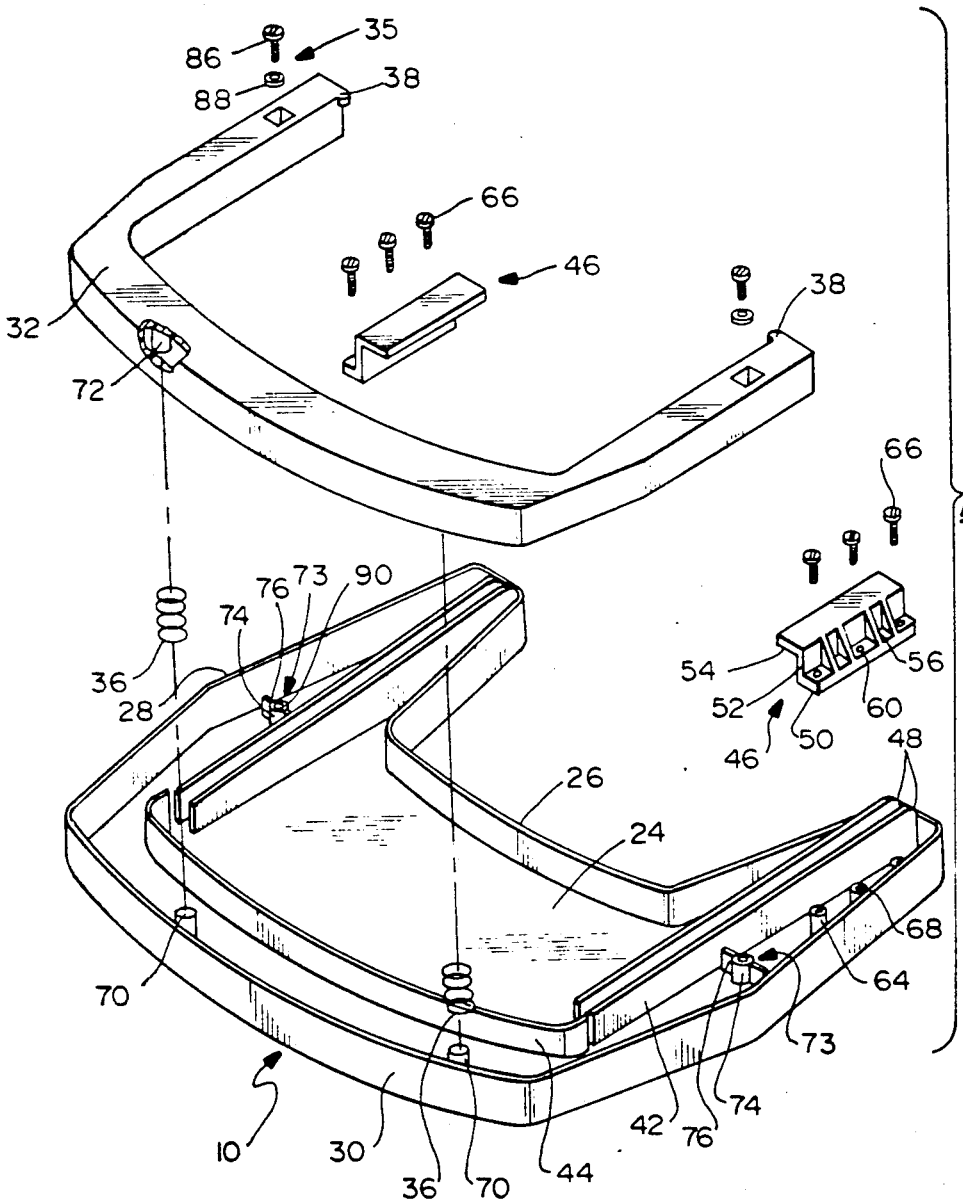
FIG. 3 is an exploded view of the underside of the tray showing the details of the tray release mechanism.

Referring to FIG. 2, the release mechanism of the present invention, indicated generally at 22, is attached to the bottom surface 24 of tray 10 and is preferably contained entirely within the area of tray 10 above bottom surface 24 defined by the rear sidewall 26, the two side sidewalls 28, and the front sidewall 30 extending perpendicularly from the respective edges of bottom surface 24. Release mechanism 22 comprises a one-piece arcuate handle or pivot bar 32, pivot means indicated generally at 34 for pivotably connecting pivot bar 32 to bottom surface 24, attachment means 35 proximate pivot means 34 for securing pivot bar 32 to bottom surface 24, and biasing means 36 to maintain pivot bar 32 and release mechanism 22 in the relaxed or engaged position. Pivot bar 32 comprises an operable middle or front portion forward of pivot means 34 extending along front sidewall 30 a back portion rearward of pivot means 34 having and two end sections extending along side sidewalls 28. As best seen in FIGS. 2 and 3, pivot bar 32 further comprises a pin 38 integral with and extending inwardly from each end section of pivot bar 32. Pins 38 are shaped to conform to grooves 20 on the undersides of arms 18. As will be described more fully below, when tray 10 is placed on arms 18, each pin 38 engages a corresponding groove 20 to maintain tray 10 in one of several horizontal positions with respect to back 16 of chair 12. Pivot bar 32 also comprises generally rectangular recessed mounting sections 40, which enable attachment means 35 to be recessed below the surface of pivot bar 32 at the center of pivot means 34.

Figure 4:
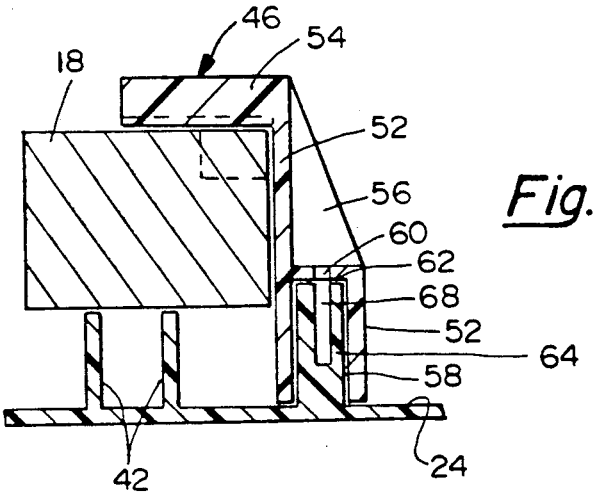
FIG. 4 is a partial cross-sectional view of the tray taken along line 4—4 of FIG. 2, with a section of the high chair arm depicted therewith.

Tray 10 is provided with guide rails 42 positioned along the end sections of pivot bar 32, an arcuate guard wall 44 adjacent the middle section of pivot bar 32, and a guide clip 46 adjacent each end section of pivot bar 32. Guide rails 42 are comprised of two parallel rails extending perpendicularly from rear sidewall 26 substantially the entire length of side sidewalls 28 and can be either manufactured as part of tray 10 or connected to rear sidewall 26 and bottom surface 24 of tray 10 by appropriate means. The top surfaces of arms 18 are wider than the parallel rails defining guide rails 42. Thus, the parallel rails of guide rails 42 slide along the top surface of each respective arm 18 and position tray 10 with respect to arms 18 (FIG. 4). The height of guide rails 42 is slightly greater than the height of rear sidewall 26 where guide rails 42 connect to rear sidewall 26, and gradually decreases along the length of guide rails 42 until the height at the end of guide rails 42 is approximately the same as the height of side sidewalls 28. The slope of guide rails 42 maintains the top surface of tray 10 tilted slightly forward to help direct spilled liquids away from the child. The portions of guide rails 42 extending above rear sidewall 26 have rounded edges 48 to help guide the ends of arms 18 into the spaces between guide rails 42 and guide clips 46 as tray 10 is being attached to high chair 12. Guard wall 44 extends perpendicularly from bottom surface 24 along the inner facing side of pivot bar 32 between both guide rails 42. Guard wall 44 eliminates the pinch point between pivot bar 32 and bottom surface 24 and thus prevents injury to the infant or the adult holding tray 10. Guard wall 44 can be either manufactured as part of tray 10 or attached to bottom surface 24 by appropriate means. Preferably, tray 10 is made of a durable plastic material and guard wall 44 and guide rails 42 are molded as part of tray 10 in a single molding operation.

Referring to FIGS. 3 and 4, each guide clip 46 comprises a horizontal base 50, a vertical sidewall 52 extending vertically from one side of base 50, a horizontal overhang 54 extending opposite base 50 from the distal edge of sidewall 52, and a number of webs or flanges 56 extending from base 50 to sidewall 52. Guide clips 46 further comprise a plurality of generally cylindrical recesses 58 extending vertically from the underside of base 50 a distance less than the height of base 50. A number of holes 60 corresponding to the number of recesses 58 extend vertically from the top surface of base 50 to the centers of the ends of recesses 58 to thereby form a vertical passage entirely through base 50. The diameter of holes 60 is smaller than that of the ends of recesses 58, the difference in diameters thereby defining an annular shoulder 62 at the end of each recess 58. Guide clips 46 are mountable on generally cylindrical bosses 64, which extend vertically from bottom surface 24 and correspond substantially to the shape and height of recesses 58. Guide clips 46 are placed on bottom surface 24 so that bosses 64 extend into recesses 58 until the distal ends of bosses 64 are proximate shoulders 62. Guide clips 46 are then fastened to tray 10 by preferably self-tapping screws 66, which extend through holes 60 and into corresponding holes 68 in bosses 64, or by any appropriate means. Guide clips 46 are manufactured or molded as a single piece out of a durable, lightweight material, such as plastic.

Vertical sidewalls 52 of guide clips 46 are chosen to be sufficiently high to easily accommodate the thickness of arms 18. In addition, the thickness of overhang 54 preferably tapers toward the end closest to rear sidewall 26 to form an inclined plane parallel to guide rails 42 to define a uniform channel into which each arm 18 slides (FIG. 4). Thus, when placing tray 10 on high chair 12, arms 18 are received between guide rails 42 and overhand 54 of guide clip 46. Arms 18 are then guided between overhang 54 and the decreasing height of guide rails 42 so that tray 10 is properly positioned and pitched forward with respect to high chair 12. Overhangs 54 engage the undersides of arms 18 to prevent tipping or vertical displacement of tray 10 once it is positioned on high chair 12 and during horizontal adjustment of tray 10 with respect to high chair 12. In addition, sidewalls 52 of guide clips 46 engage the outer facing sides of arms 18 to position tray 10 laterally with respect to chair 12.

Biasing means in the form of coiled springs 36 extend between bottom surface 24 of tray 10 and the underside of the middle or forward section of pivot bar 32. Preferably, for stability purposes, two biasing means or springs 36 are employed as shown in FIG. 3, although a single biasing means could be used without departing from the scope of the present invention. Springs 36 are connected to bottom surface 24 over bosses 70 extending vertically from bottom surface 24, and to pivot arm 32 by way of cups 72 extending from the underside of pivot arm 32. Bosses 70 are shorter than the height of front sidewall 30 to permit pivot arm 32 to be pressed toward bottom surface 24 to actuate release mechanism 22. When release mechanism 22 is in the relaxed position, springs 36 bias the portion of pivot bar 32 forward of pivot means 34 away from bottom surface 24. In this position, the ends of pivot bar 32 behind pivot means 34 are biased toward bottom surface 24.

Figure 5:
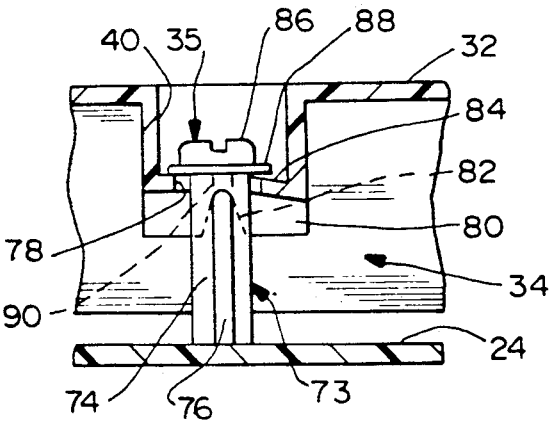
FIG. 5 is a partial broken view of the pivot portion of the release mechanism taken along line 5—5 of FIG. 2.
Figure 8:
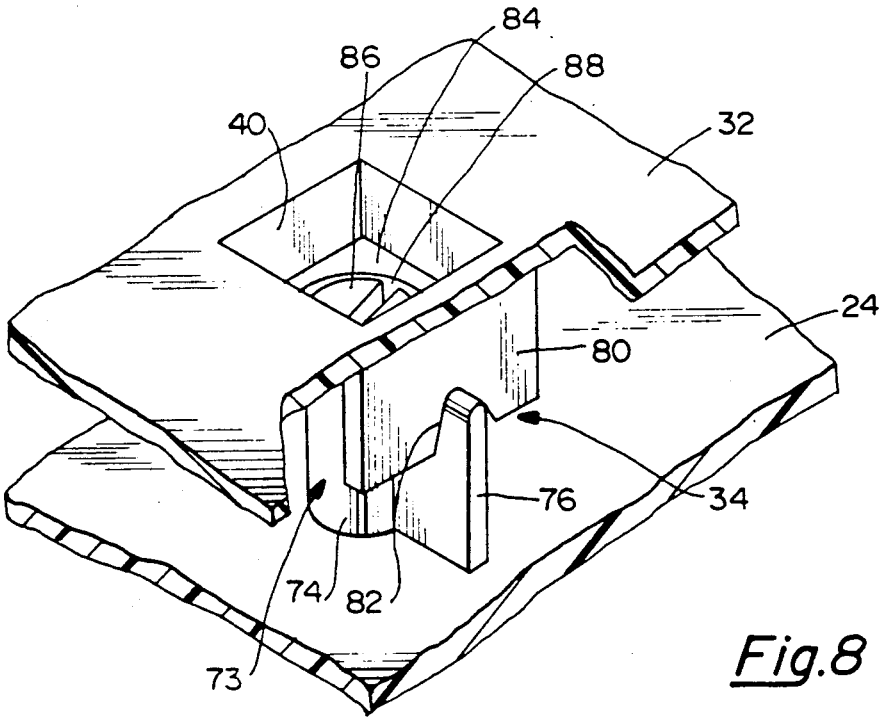
FIG. 8 is an enlarged, cut-away perspective view of the pivot portion of the release mechanism depicted in FIG. 5.

Referring to FIGS. 3, 5 and 8, each pivot means 34 comprises a fulcrum 73 defined by a generally cylindrical boss 74 extending vertically from bottom surface 24 of tray 10, and two rectangular support webs 76 extending laterally from opposite sides of boss 74 towards the side sidewalls 28 of tray 10. Each recessed mounting section 40 of pivot bar 32 comprises an annular opening 78 large enough to allow boss 74 to extend therethrough. Referring to FIGS. 5 and 8, each pivot means 34 further comprises two pivot flanges 80, one on each side of opening 78, extending vertically from the underside of mounting section 40 in a direction substantially perpendicular to support webs 76. Each pivot flange 80 is provided with a central V-shaped groove 82 opening toward bottom surface 24 of tray 10. When pivot arm 32 is assembled with tray 10 (FIGS. 5 and 8), the tops of support webs 76 pivotably engage grooves 82 of pivot flanges 80, and boss 74 extends through annular opening 78 to the extent that the top of boss 74 is substantially flush with the bottom surface 84 of recessed mounting section 40. In this manner, pivot flanges 80 are pivotable about support webs 76 and, therefore, pivot arm 32 is pivotable with respect to the bottom surface 24 of tray 10. Bottom surface 84 of mounting section 40 slopes downward toward rear sidewall 26 of tray 10 so that mounting section 40 can accommodate pivotable movement of surface 84 relative to washer 88 of attachment means 35 described below.

Each attachment means 35 comprises a screw 86 and a washer 88 having an outer diameter larger than annular opening 78 and an inner diameter smaller than the diameter of the top of boss 74. Screw 86 extends through washer 88 and into a corresponding hole 90 in boss 74 to secure washer 88 against boss 74 over annular opening 78. Screw 86 is preferably self-tapping.

Figure 6:
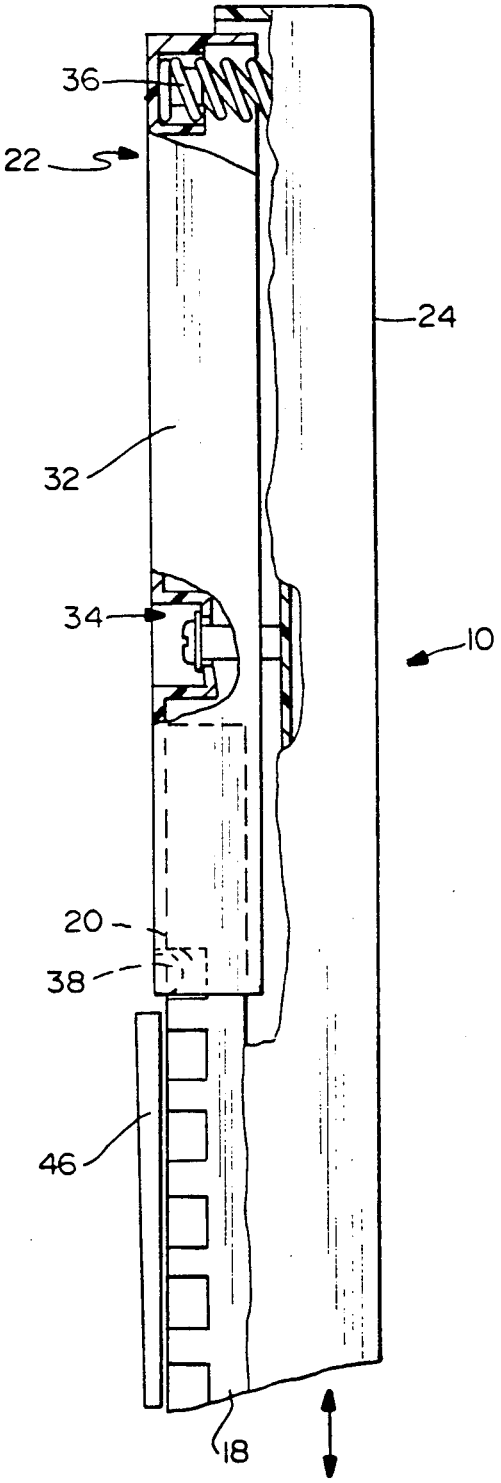
FIG. 6 is a partial cross-sectional view showing the tray attached to the high chair arm with the release mechanism in its relaxed or engaged position.

Referring to FIG. 6, release mechanism 22 is shown in its engaged position, wherein no external force is applied to pivot bar 32. In this position, spring 36 forces the portions of pivot arm 32 forward of pivot means 34 away from bottom surface 24 of tray 10. This causes pivot bar 32 to pivot about pivot means 34, thereby forcing pins 38 on the ends of pivot bar 32 against arms 18. When tray 10 is positioned appropriately horizontally on arms 18, each pin 38 will be forced by action of spring 36 on pivot bar 32 recess 20 on the underside of corresponding arm 18 to thereby secure pivot bar 32 and, therefore tray 10 to arms 18 in one of several horizontal positions defined by recesses 20. Thus, the engagement of pins 38 with a set of corresponding recesses 20 maintains tray 10 in a fixed horizontal position on arms 18 with respect to back 16 of chair 12. The horizontal position of tray 10 can be adjusted by sliding tray 10 toward or away from back 16 until pins 38 engage a different set of corresponding recesses 20 relating to the horizontal position desired.

Figure 7:
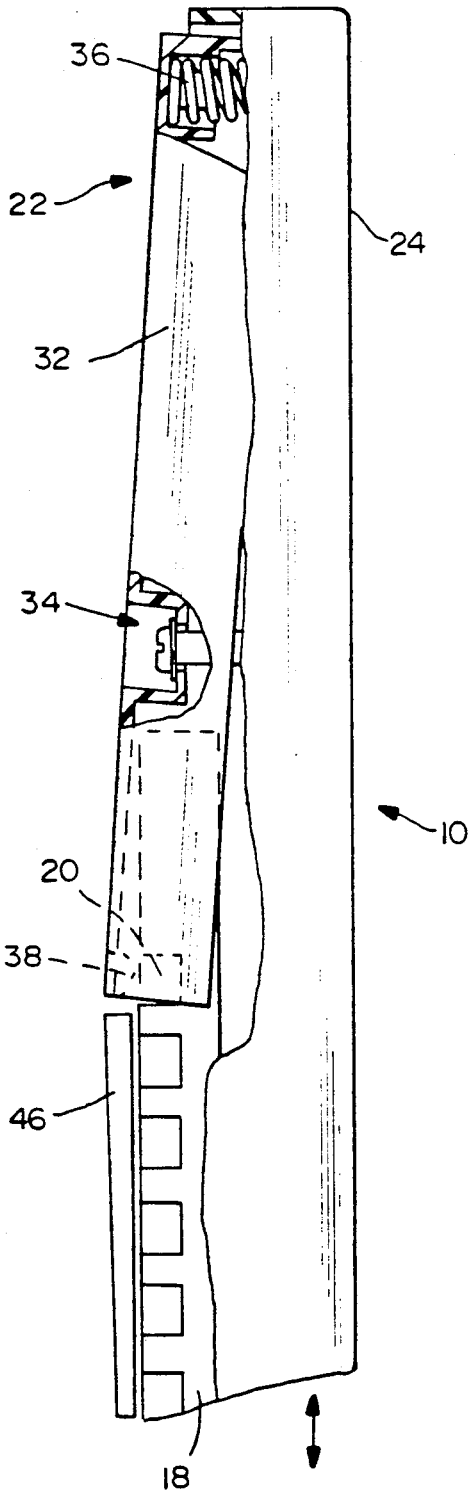
FIG. 7 is a partial cross-sectional view showing the tray attached to the high chair arm with the release mechanism in its compressed or disengaged position.

Referring to FIG. 7, the disengaged condition of release mechanism 22 is achieved by grasping pivot bar 32, either with one hand along the forward portion or with two hands on the side portions of pivot bar 32 forward of pivot means 34, and pressing pivot bar 32 toward bottom surface 24 of tray 10. One-handed operation of release mechanism 22 is easily achieved by grasping tray 10 and pivot bar 32 between the thumb and fingers and closing the hand in a simple grasping motion. The movement of the thumb and fingers is therefore similar to the manipulation employed in grasping tray 10 with one hand to adjust it horizontally with respect to high chair 12 or to remove tray 10 from high chair 12 and transport it to another location. When the portion of pivot bar 32 forward of pivot means 34 is pressed toward bottom surface 24 of tray 10, pivot bar 32 pivots about pivot means 34, thereby lifting pins 38 out of the set of corresponding recesses 20 on the undersides of arms 18. In this position, tray 10 is free to slide horizontally forward or backward along arms 18. Thus, when pivot bar 32 is compressed, tray 10 can be adjusted horizontally along arms 18 until the desired position is obtained, whereby releasing pivot bar 32 will force pins 38 into a set of corresponding recesses 20 and thereby secure tray 10 to arms 18, or tray 10 can be removed completely from high chair 12 by sliding it forward until guide clips 46 clear the ends of arms 18.

Tray 10 is preferably manufactured or molded as one piece. Thus, guide rails 42, guard wall 44, bosses 64 for mounting guide clips 46, bosses 70 for mounting springs 36, and fulcrum 73 of pivot means 34 are molded as part of bottom surface 24 of tray 10 in a single operation. Also, pivot bar 32 is preferably manufactured as a single piece, with pins 38, mounting section 40, pivot flanges 80, and cups 72 being molded with pivot bar 32 in a single operation. Pivot bar 32 is preferably made of plastic, or any other lightweight but durable material. Therefore, tray 10 is simple to manufacture and assemble and, thus, cost-effective to produce.

It should be recognized that, while the present invention has been described in relation to the preferred embodiment thereof, those skilled in the art may develop a wide variation of structural details without departing from the principles of the invention. Therefore, the appended claims are to be construed to cover all equivalents falling within the true scope and spirit of the invention.

What is claimed is:

1. A device for releasably securing a tray having a top surface and a bottom surface to a chair having two extending arms with a plurality of consecutive recessed grooves on the underside of each arm, which comprises:

(a) a one-piece pivot bar;

(b) pivot means for pivotably connecting said pivot bar to the bottom surface of said tray;

(c) said pivot bar comprising an operable front portion forward of said pivot means, a back portion rearward of said pivot means, and at least two pins extending from said back portion for engaging a set of corresponding grooves comprising at least one groove on the underside of each arm;

(d) attachment means proximate said pivot means for securing said pivot bar to the bottom surface of said tray; and (e) biasing means associated with said pivot bar for urging said back portion toward the bottom surface of said tray and, therefore, said pins into the set of corresponding grooves when said tray is positioned on the arms of said chair to thereby secure said tray to said arms, whereby operation of said pivot bar in opposition to said biasing means causes said pins to retreat from said grooves.

2. The device of claim 1, wherein said front portion of said pivot bar conforms to and is positioned adjacent the front edge of said tray.

3. A device for releasably securing a tray having a top surface and a bottom surface to a chair having two extending arms with a plurality of consecutive recessed grooves on the underside of each arm, which comprises:

(a) a one-piece pivot bar;

(b) pivot means for pivotably connecting said pivot bar to the bottom surface of said tray;

(c) said pivot bar comprising an operable front portion forward of said pivot means, a back portion rearward of said pivot means, and at least two pins extending from said back portion for engaging a set of corresponding grooves comprising at least one groove on the underside of each arm;

(d) attachment means proximate said pivot means for securing said pivot bar to the bottom surface of said tray;

(e) biasing means associated with said pivot bar for urging said back portion toward the bottom surface of said tray and, therefore, said pins into the set of corresponding grooves when said tray is positioned on the arms of said chair to thereby secure said tray to said arms, whereby operation of said pivot bar in opposition to said biasing means causes said pins to retreat from said grooves;

(f) wherein said front portion of said pivot bar conforms to and is positioned adjacent the front edge of said tray; and (g) wherein said back portion of said pivot bar comprises two end sections extending rearwardly from opposite ends of said front portion along the sides of said tray and said pins extend laterally from said end sections.

4. A device for releasably securing a tray having a top surface and a bottom surface to a chair having two extending arms with a plurality of consecutive recessed grooves on the underside of each arm, which comprises:

(a) a one-piece pivot bar;

(b) pivot means for pivotably connecting said pivot bar to the bottom surface of said tray;

(c) said pivot bar comprising an operable front portion forward of said pivot means, a back portion rearward of said pivot means, and at least two pins extending from said back portion for engaging a set of corresponding grooves comprising at least one groove on the underside of each arm;

(d) attachment means proximate said pivot means for securing said pivot bar to the bottom surface of said tray;

(e) biasing means associated with said pivot bar for urging said back portion toward the bottom surface of said tray and, therefore, said pins into the set of corresponding grooves when said tray is positioned on the arms of said chair to thereby secure said tray to said arms, whereby operation of said pivot bar in opposition to said biasing means causes said pins to retreat from said grooves; and (f) wherein each of said pivot means comprises a fulcrum integral with the bottom surface of said tray and at least one pivot flange integral with the underside of said pivot bar which pivotably engages said fulcrum to permit pivotal movement of said pivot bar about said fulcrum when said pivot bar is secured to the bottom surface of said tray by said attachment means.

5. The device of claim 4, wherein said fulcrum comprises a vertical cylindrical boss and two rectangular support webs extending from opposite sides of said boss towards the sides of said tray.

6. The device of claim 5, wherein said pivot bar further comprises an annular opening proximate each of said at least one pivot flanges having a diameter larger than the diameter of said boss, whereby the top of said boss extends through said annular opening in said pivot bar when said pivot bar is assembled with said tray.

7. The device of claim 6, wherein each of said attachment means comprises a washer, having an inner diameter smaller than the diameter of said boss and an outer diameter larger than the diameter of said annular opening, and a screw which extends through the washer and into a corresponding bore in said boss to fasten said washer to the top of said boss over said annular opening and thereby secure said pivot bar to the bottom surface of said tray.

8. The device of claim 7, wherein the sections of said pivot bar adjacent each of said annular openings are recessed below the surface of said pivot bar.

9. A device for releasably securing a tray having a top surface and a bottom surface to a chair having two extending arms with a plurality of consecutive recessed grooves on the underside of each arm, which comprises:

(a) a one-piece pivot bar;

(b) pivot means for pivotably connecting said pivot bar to the bottom surface of said tray;

(c) said pivot bar comprising an operable front portion forward of said pivot means, a back portion rearward of said pivot means, and at least two pins extending from said back portion for engaging a set of corresponding grooves comprising at least one groove on the underside of each arm;

(d) attachment means proximate said pivot means for securing said pivot bar to the bottom surface of said tray;

(e) biasing means associated with said pivot bar for urging said back portion toward the bottom surface of said tray and, therefore, said pins into the set of corresponding grooves when said tray is positioned on the arms of said chair to thereby secure said tray to said arms, whereby operation of said pivot bar in opposition to said biasing means causes said pins to retreat from said grooves; and (f) wherein said biasing means comprises at least one spring.

10. The device of claim 9, wherein said biasing means further comprises a receptacle associated with the underside of said pivot bar for connecting one end of said spring to said pivot bar, and a boss associated with the bottom surface of said tray for connecting the other end of said spring to the bottom surface of said tray.

11. In combination with a tray having a top surface and a bottom surface for a chair having two extending arms with a plurality of consecutive recessed grooves extending on the undersides of the arms, the improvement which comprises:

(a) a release mechanism having a one-piece pivot bar; pivot means for pivotably connecting said pivot bar to the bottom surface of said tray; said pivot bar comprising an operable front portion forward of said pivot means, a back portion rearward of said pivot means, and at least two pins extending from said back portion for engaging said grooves; attachment means proximate said pivot means for securing said pivot bar to the bottom surface of said tray; and biasing means associated with said pivot bar for urging said back portion toward the bottom surface of said tray and, therefore, said pins into a set of corresponding grooves when said tray is positioned on the arms of said chair to thereby secure said tray to said arms, whereby operation of said pivot bar in opposition to said biasing means causes said pins to retreat from said grooves;

(b) two guide clips attached to the bottom surface of said tray adjacent the back portion of said pivot bar and extending about the undersides of said arms when said tray is positioned on said arms to restrict both lateral and vertical movement of said tray with respect to said chair and guide said arms between said pins of said pivot bar and the bottom surface of said tray;

(c) two guide rails extending vertically from the bottom surface of said tray proximate the sides of said tray to guide said arms between said guide clips and the bottom surface of said tray and maintain the top surface of said tray tilted slightly forward; and (d) a guard wall extending vertically from the bottom surface of said tray adjacent said front portion of said pivot bar.

12. The combination of claim 11, wherein said front portion of said pivot bar conforms to and is positioned adjacent the front edge of said tray.

13. The combination of claim 12, wherein said back portion of said pivot bar comprises two end sections extending rearwardly from opposite ends of said front portion along the sides of said tray and said pins extend laterally from said end sections.

14. The combination of claim 11, wherein each of said pivot means comprises a fulcrum integral with the bottom surface of said tray and at least one pivot flange integral with the underside of said pivot bar which pivotably engages said fulcrum to permit pivotal movement of said pivot bar about said fulcrum when said pivot bar is secured to the bottom surface of said tray by said attachment means.

15. The combination of claim 14, wherein said fulcrum comprises a vertical cylindrical boss and two rectangular support webs extending from opposite sides of said boss towards the sides of said tray.

16. The combination of claim 15, wherein said pivot bar further comprises an annular opening proximate each of said at least one pivot flanges having a diameter larger than the diameter of said boss, whereby the top of said boss extends through said annular opening in said pivot bar when said pivot bar is assembled with said tray.

17. The combination of claim 16, wherein each of said attachment means comprises a washer, having an inner diameter smaller than the diameter of said boss and an outer diameter larger than the diameter of said annular opening, and a screw which extends through the washer and into a corresponding bore in said boss to fasten said washer to the top of said boss over said annular opening and thereby secure said pivot bar to the bottom surface of said tray.

18. The combination of claim 17, wherein the sections of said pivot bar adjacent each of said annular openings are recessed below the surface of said pivot bar.

19. The combination of claim 11, wherein said biasing means comprises at least one spring.

20. The combination of claim 19, wherein said biasing means further comprises a receptacle associated with the underside of said pivot bar for connecting one end of said spring to said pivot bar, and a boss associated with the bottom surface of said tray for connecting the other end of said spring to the bottom surface of said tray.

21. A device for releasably securing a tray having a top surface and a bottom surface to a chair having two extending arms with a plurality of consecutive recessed grooves on the underside of each arm, which comprises:

(a) a one-piece pivot bar;

(b) pivot means for pivotably connecting said pivot bar to the bottom surface of said tray;

(c) said pivot bar comprising an operable front portion forward of said pivot means, a back portion rearward of said pivot means, and at least two pins extending from said back portion for engaging said grooves;

(d) attachment means proximate said pivot means for securing said pivot bar to the bottom surface of said tray;

(e) biasing means associated with said pivot bar for urging said back portion toward the bottom surface of said tray and, therefore, said pins into the set of corresponding grooves when said tray is positioned on the arms of said chair to thereby secure said tray to said arms, whereby operation of said pivot bar in opposition to said biasing means causes said pins to retreat from said grooves; and (f) wherein each of said pivot means comprises a fulcrum integral with the bottom surface of said tray and at least one pivot flange integral with the underside of said pivot bar which pivotably engaged said fulcrum to permit pivotal movement of said pivot bar about said fulcrum when said pivot bar is secured to the bottom surface of said tray by said attachment means.

22. The device of claim 21, wherein said fulcrum comprises a vertical cylindrical boss and two rectangular support webs extending from opposite sides of said boss towards the sides of said tray.

23. The device of claim 22, wherein said pivot bar further comprises an annular opening proximate each of said at least one pivot flanges having a diameter larger than the diameter of said boss, whereby the top of said boss extends through said annular opening in said pivot bar when said pivot bar is assembled with said tray.

24. The device of claim 23, wherein each of said attachment means comprises a washer, having an inner diameter smaller than the diameter of said boss and an outer diameter larger than the diameter of said annular opening, and a screw which extends through the washer and into a corresponding bore in said boss to fasten said washer to the top of said boss over said annular opening and thereby secure said pivot bar to the bottom surface of said tray.

25. The device of claim 24, wherein the sections of said pivot bar adjacent each of said annular openings are recessed below the surface of said pivot bar.

26. A tray for use with a chair having two extending arms with a plurality of consecutive recessed grooves on the underside of each arm, which comprises;

(a) a top surface and a bottom surface;

(b) a one-piece pivot bar;

(c) pivot means for pivotably connecting said pivot bar to the bottom surface;

(d) said pivot bar comprising an operable front portion forward of said pivot means, a back portion rearward of said pivot means, and at least two pins extending from said back portion for engaging a set of corresponding grooves comprising at least one groove on the underside of each arm;

(e) attachment means proximate said pivot means for securing said pivot bar to the bottom surface; and (f) biasing means associated with said pivot bar for urging said back portion toward the bottom surface and, therefore, said pins into the set of corresponding grooves when said tray is positioned on the arms of said chair to thereby secure said tray to said arms, whereby operation of said pivot bar in opposition to said biasing means causes said pins to retreat from said grooves.

* * * * *